US009884220B2

(12) United States Patent
Smith et al.

(10) Patent No.: US 9,884,220 B2
(45) Date of Patent: Feb. 6, 2018

(54) POTABLE CABLE RESISTANCE PULLEY EXERCISE EQUIPMENT AND RELATED METHODS

(71) Applicant: Bodyfly Fitness, LLC, La Jolla, CA (US)

(72) Inventors: Kareen Smith, La Jolla, CA (US); Seyi Ajirotutu, La Jolla, CA (US); Andrei Carnes, La Jolla, CA (US); Bobby S. Lepori, La Jolla, CA (US); Ryan Matthews, La Jolla, CA (US)

( * ) Notice: Subject to any disclaimer, the term of this patent is extended or adjusted under 35 U.S.C. 154(b) by 41 days.

(21) Appl. No.: 15/026,589

(22) PCT Filed: Aug. 1, 2014

(86) PCT No.: PCT/US2014/049497

§ 371 (c)(1),
(2) Date: Mar. 31, 2016

(87) PCT Pub. No.: WO2015/017838

PCT Pub. Date: Feb. 5, 2015

(65) Prior Publication Data

US 2016/0332021 A1 Nov. 17, 2016

Related U.S. Application Data

(60) Provisional application No. 61/861,949, filed on Aug. 2, 2013.

(51) Int. Cl.
*A63B 21/02* (2006.01)
*A63B 21/22* (2006.01)
(Continued)

(52) U.S. Cl.
CPC ..... *A63B 21/227* (2013.01); *A63B 21/0085* (2013.01); *A63B 21/023* (2013.01);
(Continued)

(58) Field of Classification Search
CPC ..... A63B 21/227; A63B 21/4035; A63B 21/4043; A63B 21/154; A63B 21/225; A63B 21/008; A63B 21/0083; A63B 21/0085; A63B 21/0087; A63B 21/023; A63B 21/0442; A63B 21/0433; A63B 23/1281; A63B 23/16; A63B 23/1218
See application file for complete search history.

(56) References Cited

U.S. PATENT DOCUMENTS 4,976,425 A * 12/1990 Barnes, Jr. ..... A63B 22/14 482/110
5,540,642 A * 7/1996 Sprague ..... A63B 23/03533 482/123

(Continued)

*Primary Examiner* — Gregory Winter
(74) *Attorney, Agent, or Firm* — Buche & Associates, P.C.; John K. Buche; Bryce A. Johnson

(57) ABSTRACT

A portable exercise apparatus having a base, at least two handle assemblies, and a cable wrapped between at least one flywheel within the base, wherein the cable is attached to a handle assembly and is affixed to a spring mechanism configured to provide resistance against the pulling of the handle assemblies. The load provided by the spring mechanism can be adjusted to accommodate more or less resistance for the user. The exercise apparatus is compact and can be used in a standing or sitting position.

14 Claims, 9 Drawing Sheets

(51) Int. Cl.

| | |
|---|---|
| ***A63B 21/008*** | (2006.01) |
| ***A63B 21/04*** | (2006.01) |
| ***A63B 21/00*** | (2006.01) |
| ***A63B 23/12*** | (2006.01) |

(52) U.S. Cl.
CPC ..... *A63B 21/0442* (2013.01); *A63B 21/154* (2013.01); *A63B 21/225* (2013.01); *A63B 21/4035* (2015.10); *A63B 21/4043* (2015.10); *A63B 23/1218* (2013.01); *A63B 23/1281* (2013.01); *A63B 2208/0204* (2013.01); *A63B 2208/0228* (2013.01)

(56) References Cited

U.S. PATENT DOCUMENTS

| | | | | |
|---|---|---|---|---|
| 7,922,624 | B1 * | 4/2011 | Fairhurst ..... | A63B 21/0552 482/52 |
| 2009/0181835 | A1 * | 7/2009 | Campitelli ..... | A63B 21/00072 482/111 |
| 2011/0177923 | A1 * | 7/2011 | Smith ..... | A63B 21/0004 482/110 |
| 2013/0090216 | A1 * | 4/2013 | Jackson ..... | A63B 21/018 482/52 |

* cited by examiner

POTABLE CABLE RESISTANCE PULLEY EXERCISE EQUIPMENT AND RELATED METHODS

CROSS-REFERENCE TO RELATED APPLICATIONS

This application is a U.S. National Phase application claiming the priority of PCT/US2014/049497 (filed Aug. 1, 2014) and entitled "PORTABLE CABLE RESISTANCE PULLEY EXERCISE EQUIPMENT AND RELATED METHODS," which application claims the benefit and priority of U.S. Prov. Pat. App. Ser. No. 61/861,949 (filed Aug. 2, 2013) entitled "PORTABLE CABLE RESISTANCE PULLEY EXERCISE EQUIPMENT AND RELATED METHODS." These document are hereby incorporated by reference in their entirety.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

REFERENCE TO A "SEQUENCE LISTING," A TABLE, OR A COMPUTER PROGRAM LISTING APPENDIX SUBMITTED ON COMPACT DISC AND AN INCORPORATION-BY-REFERENCE OF THE MATERIAL ON THE COMPACT DISC

Not applicable.

BACKGROUND OF THE INVENTION

1. Field of Invention

The subject matter of this disclosure relates to cable resistance exercise apparatus and related methods.

2. Description of Related Art

Exercise equipment is used to strengthen various muscles of the body. Personal training with exercise equipment at home and in the gym has become more and more popular due to increased public consciousness of health and outward appearance. Many different types of personal training and exercise devices, including fixed and stationary equipment, have been designed and introduced by various manufacturers. Nonetheless, these personal training and exercise devices are often cumbersome, expensive, or difficult to operate.

One category of exercise equipment is cable resistance equipment. These have generally been used to provide effective means to strengthen a user's arms, legs, and core. Known cable resistance exercise equipment generally involves a graspable handle connected to a cable that is anchored by a countering weight or force. One limitation of such equipment is that it is generally stationed to the ground and not meant to be moved. Other limitations of such equipment include lack of weight adjustment, cumbersome accompanying free weights (such as dumbbells or plates), and a need for large amounts of open space.

An example of exercise equipment that is not always satisfactory is found in U.S. Pat. No. 4,257,592 to Jones. This patent discloses exercise equipment wherein a user pulls a handle in an upwards direction counter resisted by the force applied by the user in another handle. This equipment is problematic because it relies on the user's own strength to provide resistance which can be cumbersome or counter-productive.

Another example of problematic exercise equipment is U.S. Pat. No. 5,171,295 to Felipe. This patent discloses portable exercise equipment incorporating a chair, and an elongated bar with cable pulleys on its ends. This apparatus does not disclose means for providing resistance to the pulling of the cable pulleys. In other words, this equipment is sometimes unsatisfactory because additional apparatus or the user's own strength is necessary to perform resistance exercises.

Yet still other exercise apparatus exist that are unsatisfactory for performing exercises. For example, U.S. Pat. No. 6,726,607 to Ihli discloses a portable exercise device with a platform, a pole, and a cable and pulley assembly. The device allows a user to stand on top of the platform and pull handles in order to exercise his or her arms. Pulley resistance is provided by: a clock spring wound to each pulley; and a brake wheel for resisting rotation of the pulley. The device, however, is not satisfactory because it does not provide adequately controlled resistance. Additionally, the device is unsatisfactory because friction between the pulley and the brake wheel or clock spring can cause the equipment to wear down or otherwise damage the equipment. Moreover, the device is sub-optimal because it is not compact and requires a large amount of space to operate.

In view of the foregoing, a need exists for cable and pulley based variable resistance exercise equipment that is inexpensive to construct, portable, and easy to operate and maintain.

SUMMARY OF THE INVENTION

Disclosed are new and improved exercise apparatus with cable resistance and related methods of use. More specifically, the disclosed apparatus and methods represent an improved apparatus using cables with variable resistance that may be operated from a variety of user positions. A user may operate the apparatus while standing on or adjacent the apparatus, or even while sitting thereon. From the various positions, the user may perform a variety of exercises involving upper or lower body muscle training.

In one embodiment, the disclosed equipment comprises: a base; a pair of handle assemblies; wherein each handle assembly comprise a handle and a loop; a cable wrapped circularly between two flywheels within the base; wherein the cable exits out of the base through a pulley and attaches to each of the handle assemblies; said flywheels being operatively engaged to a spring or hydraulic mechanism that stores a load generated by a compression force; wherein said load counteracts the force generated by pulling the cable via the handle assembly; and wherein said load is controllably adjusted by spring loaded or magnetic locks.

BRIEF DESCRIPTION OF THE FIGURES

The manner in which these objectives and other desirable characteristics can be obtained is better explained in the following description and attached figures in which.

Figure 1:
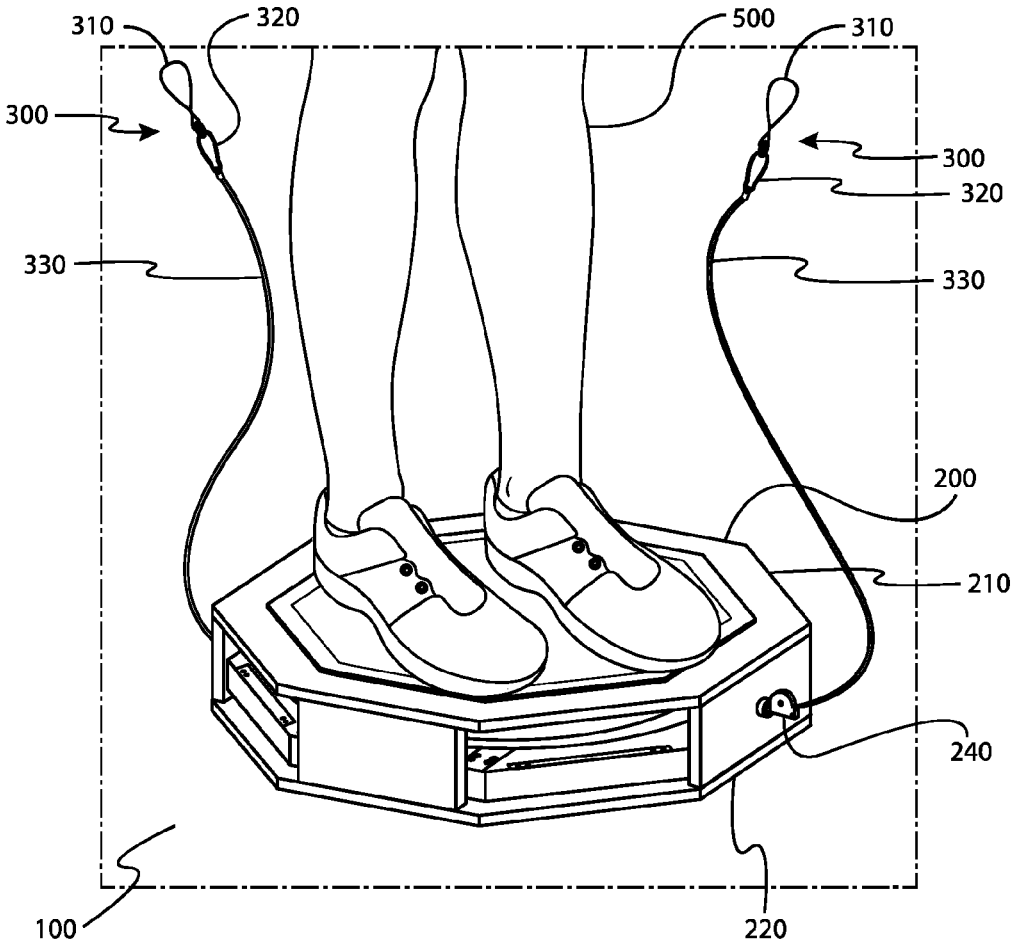
FIG. 1 is an environmental perspective view of an exercise apparatus.

It is to be noted, however, that the appended figures illustrate only typical embodiments disclosed in this specification, and therefore, are not to be considered limiting of its scope, for the invention may admit to other equally effective embodiments that will be appreciated by those reasonably skilled in the relevant arts. The components in the figures are not necessarily to scale, with an emphasis instead being placed upon illustrating the principles of the invention. In the figures, like reference numerals designate corresponding parts throughout the different views. Also, the figures are not necessarily drawn to scale.

DETAILED DESCRIPTION OF PREFERRED EMBODIMENTS

Disclosed, in general, is exercise equipment comprising: a base; a pair of handle assemblies defined by a handle and a loop; a cable wrapped circularly between two flywheels within the base; wherein the cable exits out of the base through a pulley and attaches to each of the handle assemblies; said flywheels being operatively engaged to a spring or hydraulic mechanism that stores a load generated by a compression force; wherein said load counteracts the force generated by pulling the cable via the handle assembly; and wherein said load is controllably adjusted by spring loaded or magnetic locks. The more specific features of the disclosed apparatus are described in connection with the attached figures.

FIG. 1 is an environmental perspective view of an exercise apparatus 100. Specifically, the figure shows a user 500 standing on the exercise apparatus 100. In the figure, the apparatus 100 comprises: a platform assembly (sometimes referred to as base) 200, handle assemblies 300, a cable 330 and pulley 240 on symmetrically opposed sides of the apparatus 100, and spring assemblies 400 disposed within the base 200.

FIG. 1 further illustrates the details of the base or platform assembly 200. In one embodiment, the platform assembly 200 is a polygonal or octagonal shape with, as discussed further below, two flywheels 260 and two spring assemblies 400. Suitably, the octagonal platform shape allows for stable support of a user's 500 weight during operation. As shown, the platform assembly 200 may comprise a platform 210 and a base plate 220. The platform 210 may be composed of a solid aluminum frame or a stainless steel frame which may weigh in the range of 40 to 50 pounds. The platform 210, in other embodiments, may be composed of a plastic shell and plastic components which may weigh in the range of 15 to 20 pounds. Such an embodiment composed of plastic materials may be suited for a lower end consumer version. Preferably, the platform assembly 200 may be configured to support the weight of a user 500. The platform assembly 200 can also be heavy enough to remain stationary during operation of the apparatus 100. The base plate 220 may also feature rubber feet (not shown) on the bottom of the plate to provide further stability.

FIG. 1 also shows details of the handle assemblies 300 and cable 330. Referring to that figure, the pair of handle assemblies 300 may each comprise a handle 310 and a loop 320. Both handle assemblies 300 may be connected to the cable 330 as it extends from the sides of the platform assembly 200. The loop 320 may be fastened to a cable 330 that routes through both pulleys 240 and the platform 210. The loop 320 may also be composed of a low stretch polyester. The handle 310 may be in a U-shaped form and compose of plastic. Operably, the apparatus 100 may be configured for a user 500 to stand on or adjacent to the base 200 and pull the handle assemblies 300, so that the cable 330 interacts with the flywheels 260 and spring assemblies 400 to resist said pulling. The handle 310 of each handle assembly 300 may be used to grip in order to operate the equipment by pulling. In some embodiments, additional pulleys, cables (including spring assemblies and flywheels), and handle assemblies may be added for increased use of the apparatus 100.

Figure 2:
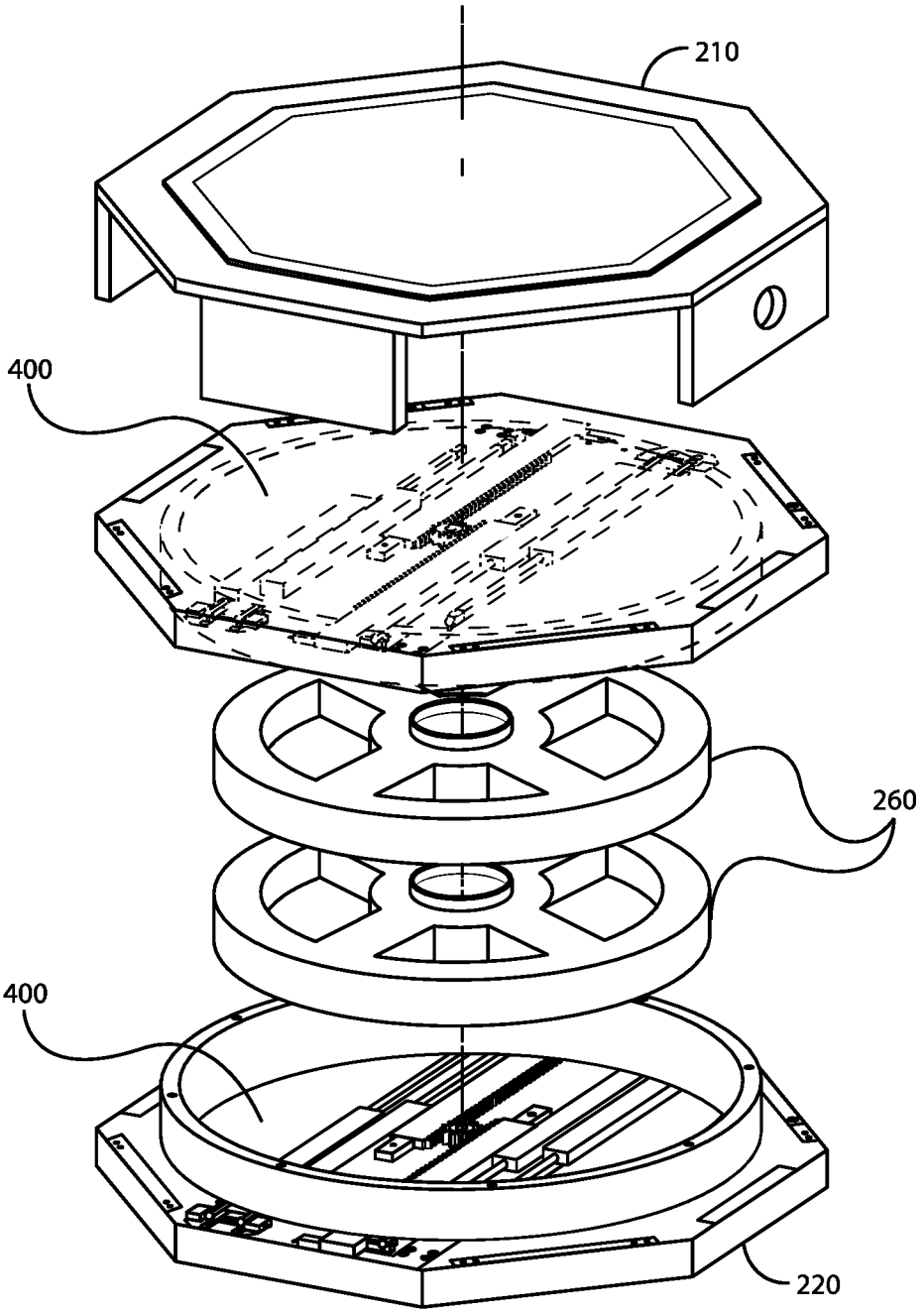
FIG. 2 is an exploded view of the exercise apparatus of FIG. 1.

FIG. 2 depicts an exploded view of the platform assembly 200 of FIG. 1. As shown, the platform assembly 200 features: a base plate 220 that defines the bottom of the base; a first spring assembly 400 that is positioned on top of the base plate 220; a first flywheel 260 assembled above the aforementioned spring assembly 400; a second flywheel 260 assembled above the first flywheel 260; a second spring assembly 400 assembled upside down (operates in a reverse direction) on top of the second flywheel 260; and a platform 210 assembled on top. Still referring to FIG. 2, the platform 210 features holes for assembly of the pulleys 240 and cable (shown in FIG. 1). The platform 210, in some embodiments, may feature large openings in some of the side panels for decreased weight or viewing of the inner workings of the apparatus 100. In other embodiments, the platform's 210 side panels are fully enclosed. The platform 210 may also include an anti-slipping surface for traction support during operation of the exercise apparatus 100.

Figure 3:
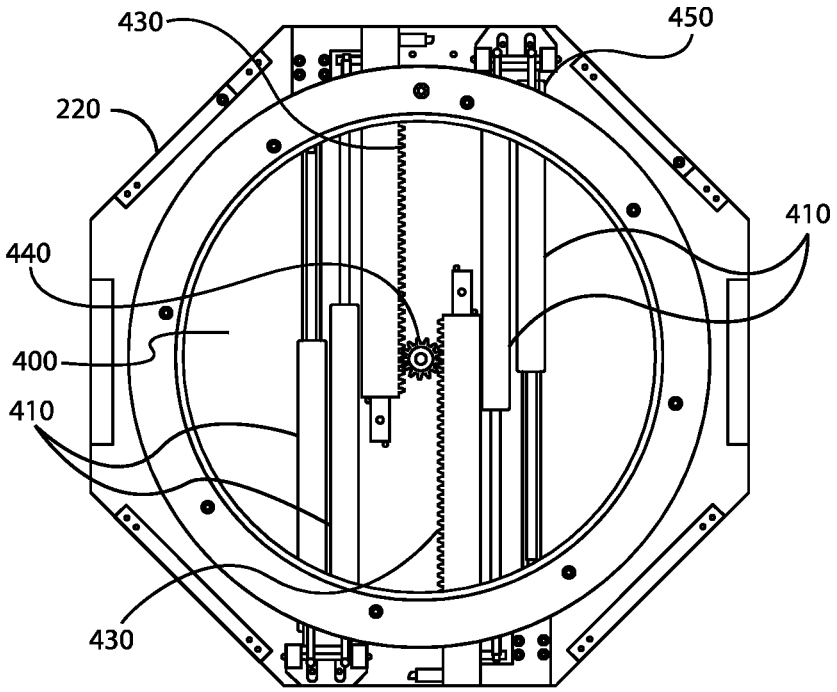
FIG. 3 is a top down view of a gas spring and rack assembly that defines a component of the exercise apparatus of FIG. 1.

FIG. 3 depicts a preferred embodiment of the spring assembly 400 of the apparatus 100. As shown, the spring assembly 400 features: springs 410 that are disposed across the top of the base plate 220 for the first spring assembly or the underside of the platform 210 for the second spring assembly 400; and a rack 430 and pinion 440. Preferably, the springs 410 may be positioned to the left or right of the rack 430 and pinion 440. In the depicted embodiment, the springs 410 are pressure loaded gas springs. Suitably, the springs 410 provide a constant force to counteract the force generated by the pulling of the handle 310. The springs 410 are affixed to the rack 430 and pinion 440, wherein the pinion 440, when mechanically coupled to a flywheel 260 (not shown in FIG. 3), translate the rotational force of the flywheel under a pulled cable 330 to a directional compressive force against the springs 410. Suitably, the springs 410 accomplish recoil of a pulled cable.

Still referring to FIG. 3, a gas spring holder 450 may be used to retain the gas spring 410 in place during operation of the apparatus 100. In some embodiments, there are three pressure loaded gas springs. In other embodiments, there are four or five pressure loaded gas springs. The pressure loaded gas springs 410 may contain a pressure of up to 1000 psi, 2000 psi, or 3000 psi. The force provided by the gas springs may range from 50 N up to 1000 N. Gas springs provide a constant force which is important to a smooth and controlled pull of the handle 310 during operation. The gas springs 410 may be composed of stainless steel or carbon steel. The gas springs 410, in some embodiments, contain nitrogen. Nitrogen provides a neutral charge which is important to avoid explosions. Nitrogen gas springs are also cheaper due to the large abundance of nitrogen in the atmosphere.

Figure 4:
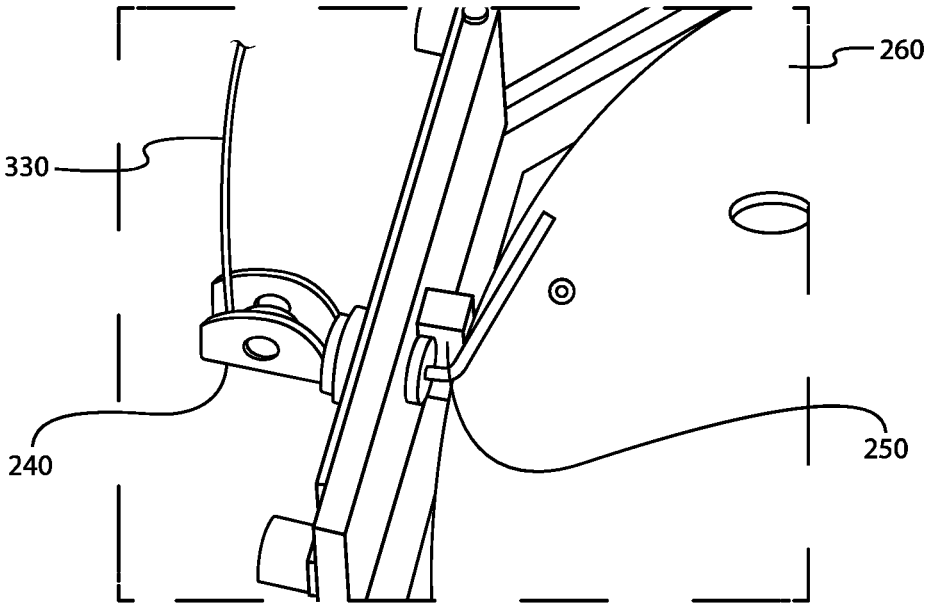
FIG. 4 is a perspective view of cable routing inside the disclosed exercise apparatus.

FIG. 4 depicts a preferable routing of the cable 330 through the platform 210. The cable 330 routes through the pulley 240 and into the platform 210, wherein the cable 330 is redirected into a circular channel 230 by a vertical bearing bar 250. The cable 330 may suitably be wound in between the two flywheels 260 and constrained by the spring assembly 400. In some embodiments (not shown here), the cable 330 may be comprised of two separate lines, in which one is fastened to the other by means of a hook. The cable 330 is configured to withstand high forces exerted upon the cable during use. In some embodiments, a winch is employed to pull in or let out cable during operation of the apparatus. In some embodiments, the cable 330 is fastened to the flywheels 260 by M6 screws. In other embodiments, the cable 330 is fastened to the flywheel 260 by bolts, nuts, or pins. The cable 330 possesses a length long enough to perform shoulder height exercises. In some embodiments, this length is 10 feet to 13 feet. In other embodiments, the cable is up to 30 feet.

Figure 5:
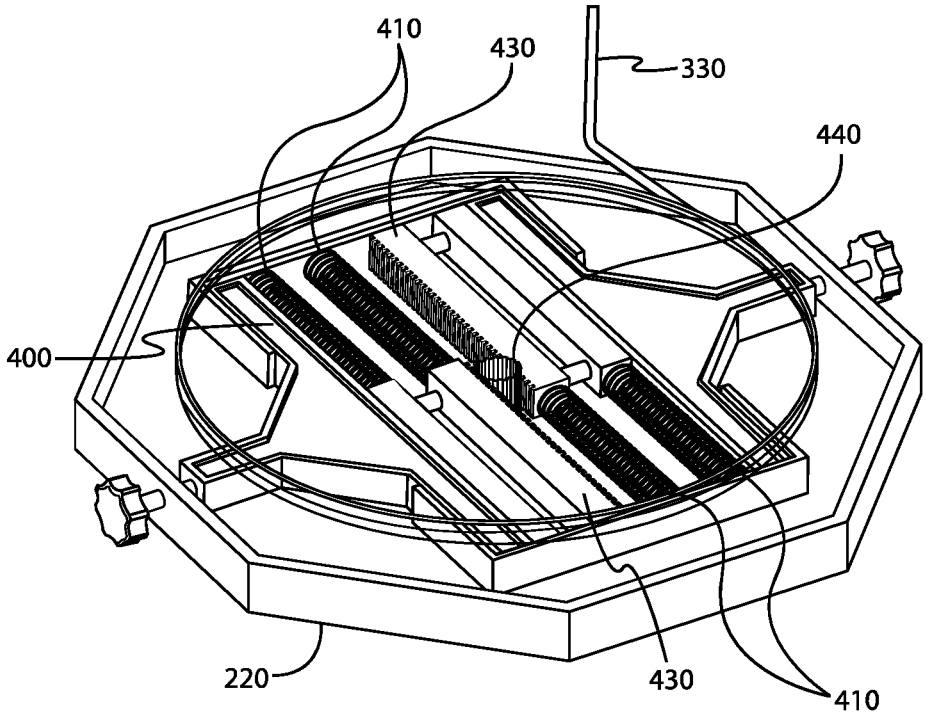
FIG. 5 is a perspective view of a mechanical spring and rack assembly inside the exercise apparatus.

FIG. 5 depicts another embodiment of a spring assembly 400 in the apparatus 100. In the depicted embodiment, the springs 410 are mechanical springs that are affixed to a rack 430 and pinion 440 which translate the motion of the force generated by the user 500 as disclosed above. Similar to the gas springs of the earlier embodiments, the mechanical springs may suitably compress to achieve proper resistance against the force of the user's 500 pull on the cable 330 during operation of the apparatus. The mechanical spring may be a coiled spring, a tension spring, a torsion spring, a variable spring, a constant spring, or a flat spring.

Figure 6:
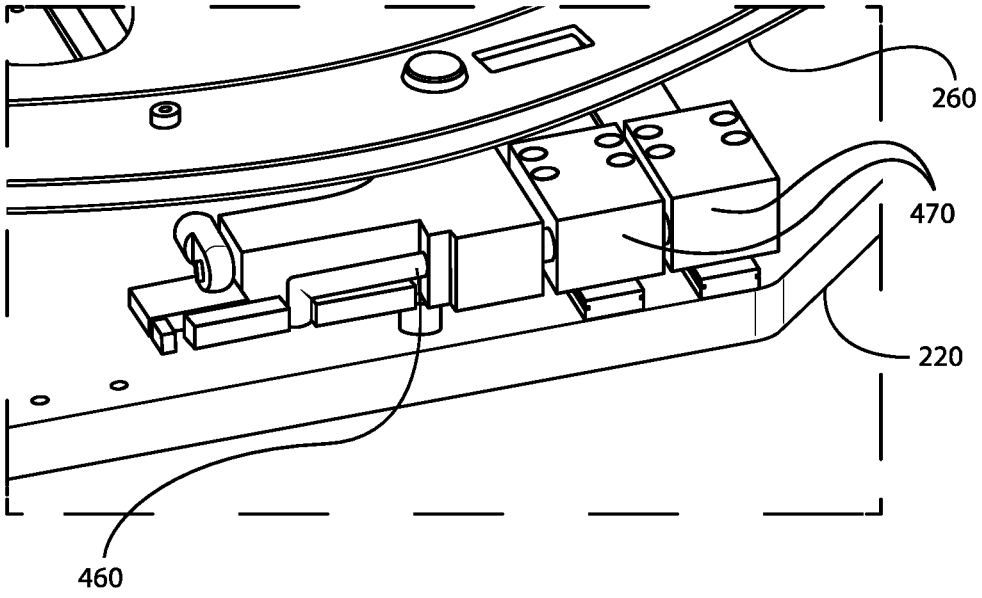
FIG. 6 is a perspective view of a spring locking mechanism of the described exercise apparatus.

FIG. 6 depicts one embodiment of a spring locking mechanism of the spring assembly 400 (see FIG. 3). As shown in the figure, the springs 410 are locked into place by an engagement pin 460. The engagement pin 460 may lock one or more springs 410 through the clutch brackets 470 or spring holder 450. In some embodiments wherein the apparatus consists of two gas springs on one end of the rack and pinion, two engagement pins (not shown) are used to lock the two isolated gas springs. Each engagement pin locks down one gas spring. In other embodiments with two gas springs on one end of the rack and pinion, one engagement pin is used to lock both gas springs. In such an embodiment, a long engagement pin may be inserted into both gas spring holders and locked in place by specified slots. An engagement block may also be used to lock both gas springs through a slide and lock mechanism, fastened by a pin to keep the block in place.

Figure 7:
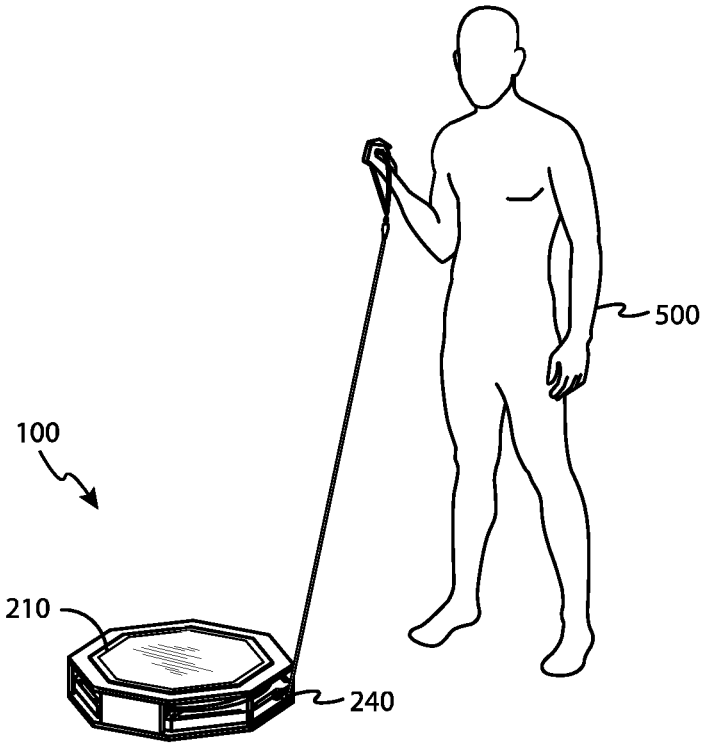
FIG. 7 is an environmental perspective view of a user operating the exercise apparatus from a nearby distance; and, FIG. 8 is a perspective view of a user operating the exercise apparatus from an elevated standpoint.
Figure 8:
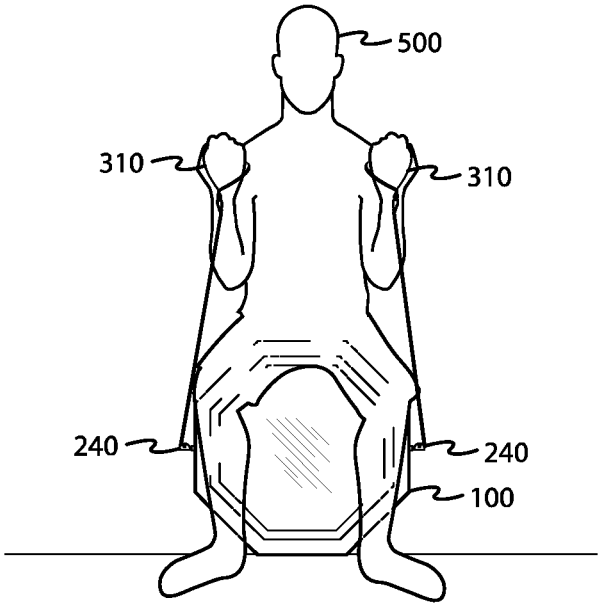

FIGS. 7 and 8 depict alternative positions for the user 500 to operate the exercise apparatus 100. In FIG. 7, the user 500 may stand a proximate distance away from the equipment. In this instance, the user may perform exercises which require extending the cable a certain distance past the pulley 240. Such exercises may include standing back-presses, bicep curls, chest fly presses, standing low rows, bent over rows, tricep extensions, lateral raises, or woodchoppers. Leg exercises may also be performed using the exercise apparatus 100 (not shown). The user 500 may kneel on the platform 210, insert his foot into the handle 310 and perform leg extensions or leg raises.

In FIG. 8, the user 500 may elevate the exercise apparatus 100 by positioning the equipment onto its side. The user 500 may then sit on the exercise apparatus 100 and operate it from this position. The pulleys 240 on each side are able to rotate according to the direction of the user's 500 pull of the handle 310. While sitting, the user 500 may use his feet to brace himself during operation of the apparatus. Exercising while sitting may allow the user 500 to isolate certain muscles of the body more readily compared to standing up.

Figure 9:
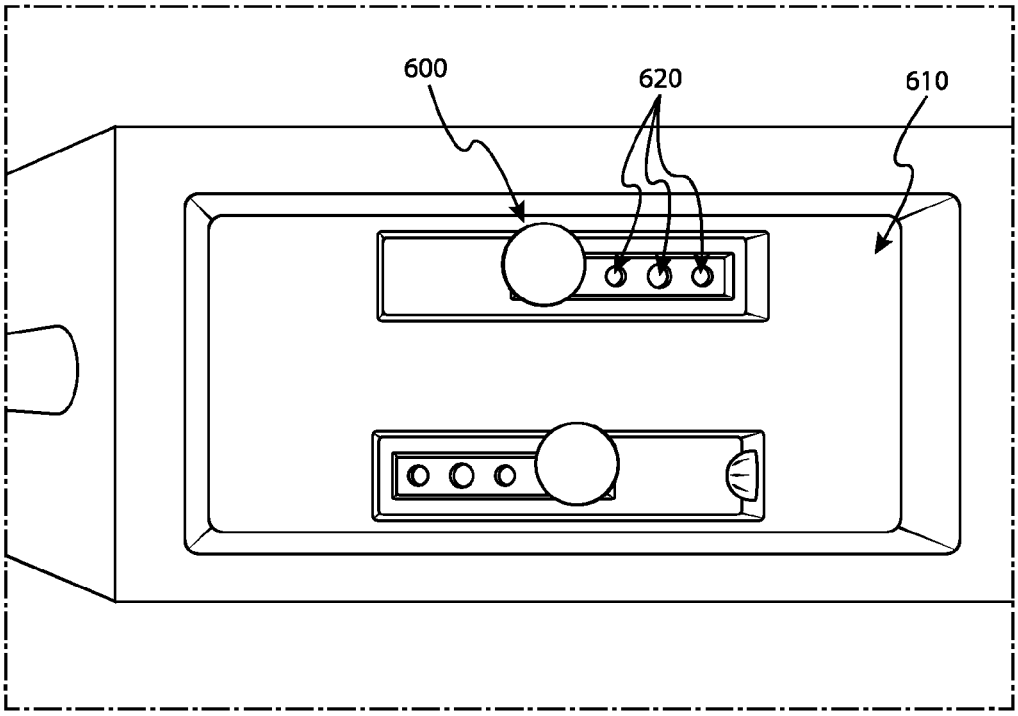
FIG. 9 is a front view of an embodiment of a spring tension adjustment mechanism.

In FIG. 9, the compression force of the spring (not shown) may be controlled by adjusting a spring loaded pin 600 movable between pin holes 620 in a slot 610. The pin holes 620 correspond to preset spring tension conditions. The preset tension conditions may adjust resistance in the range of 10 to 50 pounds. In some embodiments, the preset tension conditions adjust resistance in the amount of either 10, 20 or 30 pounds. The apparatus may have labels indicating which spring loaded pin 600 corresponds to a particular cable. The apparatus may also have labels indicating the resistance tension of each cable. In some other embodiments, the compression force can be adjusted by manual adjustment of the springs.

Figure 10:
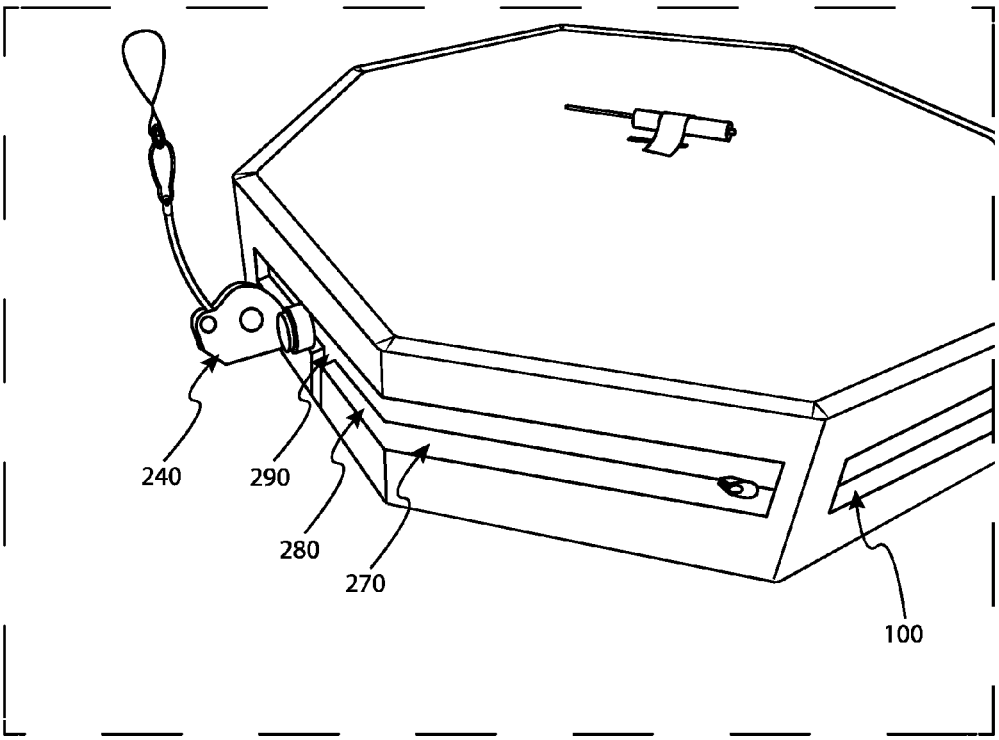
FIG. 10 is a perspective view of the apparatus of FIG. 1 with a pulley adjustment mechanism.

In FIG. 10, the positioning of the pulley 240 may be adjusted around the apparatus 100. The pulley 240 may be attached to a pulley plate 290 that slides within a pulley slot 270 within the apparatus 100. The positioning of the pulley plate 290 changes the pulling direction of the pulley and allows for different exercises. The pull pin 280 engages and locks into a pin hole (not shown) to lock the pulley plate 290 in a certain position. A user may pull the pull pin 280 which disengages the pulley plate 290 and allows the user to slide the pulley plate 290 along the pulley slot 270. In one configuration, the pulleys 240 may be oriented on a parallel axis relative to one another. In another configuration, each pulley 240 may be oriented at a 45° angle relative to the central plane of the apparatus 100.

Figure 11:
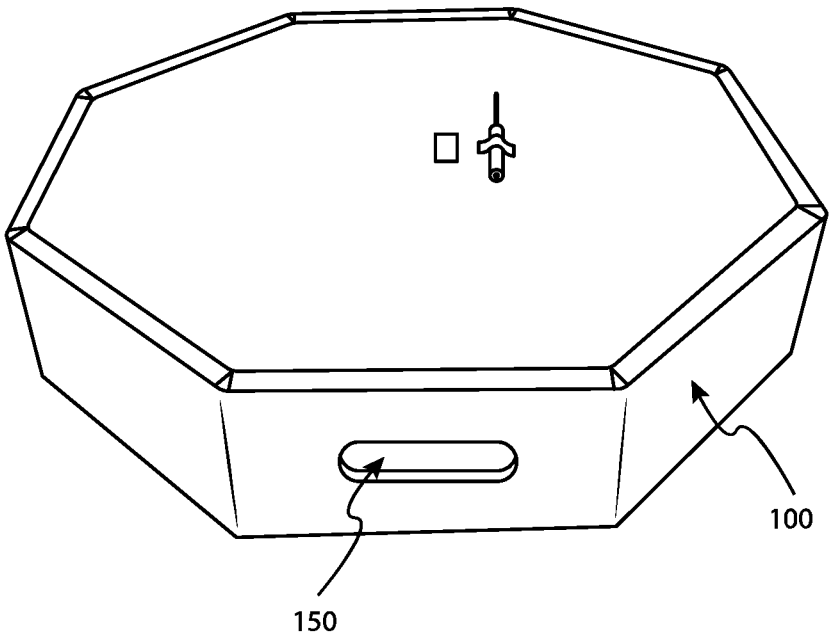
FIG. 11 is a perspective view of the apparatus of FIG. 1 with handle; and, FIG. 12 is a perspective open view of an alternate embodiment of the apparatus which illustrates an alternate spring tension mechanism.

In FIG. 11, the apparatus may feature a handle slot 150 to lift and carry the apparatus 100. In other embodiments, the apparatus may feature carrying straps to carry the apparatus on a user's back or in a user's hands.

Figure 12:
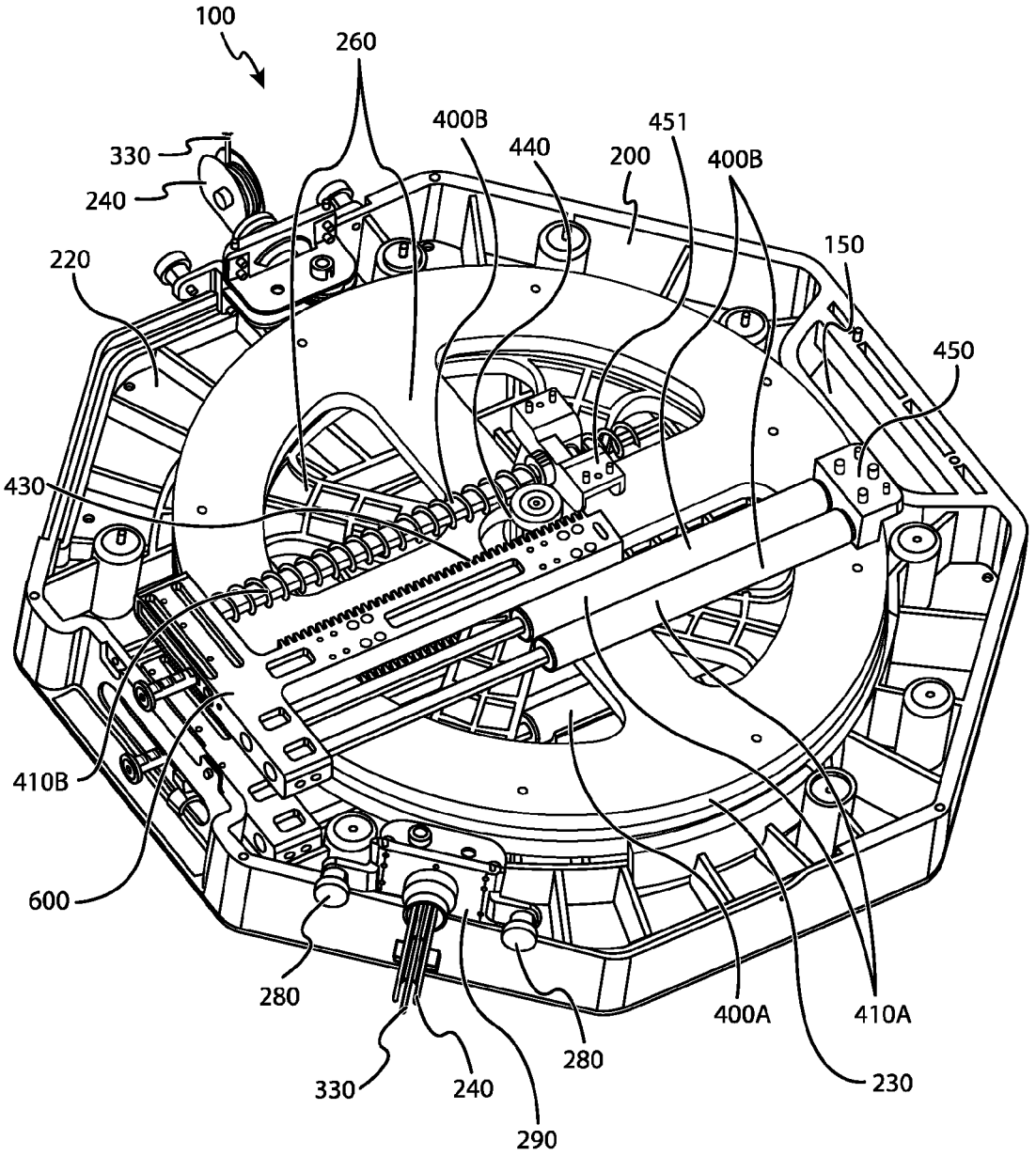

FIG. 12 illustrates an open view of an alternate embodiment of the disclosed apparatus 100. Although shown in an open view, the apparatus 100, as with the earlier embodiment, is configured for a user (not shown) to stand on the exercise apparatus 100. The apparatus 100 comprises: a platform assembly (sometimes referred to as base) 200 (partially shown), handle assemblies (not shown), a cable 330 and pulley 240 on symmetrically opposed sides of the apparatus 100, and spring assemblies 400 A-B disposed within the base 200.

FIG. 12 further illustrates the details of the base or platform assembly 200. In one embodiment, the platform assembly 200 is a polygonal or octagonal shape with, as discussed further below, two flywheels 260 and spring assemblies 400 A-B. Suitably, the octagonal (or other polygonal) platform shape allows for stable support of a user's (not shown) weight during operation. As shown, the platform assembly 200 may comprise a platform 210 (not shown) and a base plate 220, but a user may stand on the platform or base plate during mounted use. Suitably, in this embodiment, the platform 210 (not shown) and base plate 220 are mirrored components and cooperate to form the base 200. The platform 210 (not shown) and base plate 220 may be composed of a plastic shell and plastic components which may weigh in the range of 15 to 20 pounds, although other weights may also be suitable. Preferably, the platform assembly 200 may be configured to support the weight of a user (not shown) on either the base plate 220 or the platform 210 (not shown). The platform assembly 200 can also be heavy enough to remain stationary during operation of the apparatus 100. The base plate 220 and platform 210 (not shown) may also feature rubber feet (not shown) to provide further stability.

FIG. 12 also shows details of the cable 330. Referring to that figure, the cable 330 routes through pulleys 240 and the base plate 220. Operably, the apparatus 100 may be configured for a user (not shown) to stand on or adjacent to the base 200 and pull handle assemblies (not shown), so that the cable 330 interacts with the flywheels 260 and spring assemblies 400 to resist said pulling. In some embodiments, additional pulleys, cables (including spring assemblies and flywheels), and handle assemblies may be added for increased use of the apparatus 100. In a basic operation, the user pulls the cable(s); the cables turn the flywheels whose resistance is set by the spring assemblies, whose resistance may be adjusted via the toothed rack and pinion and the locking means 600. The locking means 600 may feature magnetically engageable positions that slide and lock the springs to particular variable levels of resistance. Thus, a user may move the means to accommodate "heavy" resistance, "medium" resistance or "light" resistance focusing on cardio.

Still referring to FIG. 12, the platform assembly 200 features: a base plate 220 that defines the bottom of the base 200; a first spring assembly 400A that is positioned on top of the base plate 220; a first flywheel 260 assembled above the aforementioned spring assembly 400A; a second flywheel 260 assembled above the first flywheel 260; a second spring assembly 400B assembled on top of the second flywheel 260; and a platform (not shown) assembled on top. Still referring to FIG. 12, the base plate features holes for assembly of the pulleys 240 and cable. The base plate 220 may also include an anti-slipping surface for traction support during operation of the exercise apparatus 100.

FIG. 12 depicts another preferred embodiment of the spring assembly 400 of the apparatus 100. As shown, the spring assembly 400 features: gas springs 410 and compression springs 410B that are disposed across the top of the base plate 220 for the first spring assembly 400A or the underside of the platform (not shown) for the second spring assembly 400B; and a rack 430 and pinion 440. Preferably, the springs 410 may be positioned to the left or right of the rack 430 and pinion 440. In the depicted embodiment, the springs 410A are pressure loaded gas springs; the compression spring 410B is a rod guided. Suitably, the springs 410 provide a constant force to counteract the force generated by the pulling of the cable 330. The springs 410 are affixed to the rack 430 and pinion 440, wherein the pinion 440, when mechanically coupled to a flywheel 260, translate the rotational force of the flywheel under a pulled cable 330 to a directional compressive force against the springs 410. Suitably, the springs 410 accomplish recoil of a pulled cable.

Still referring to FIG. 12, a gas spring holder 450 may be used to retain the gas spring 410A in place during operation of the apparatus 100. A compression spring holder 451 may be used to retain the compression spring 410B in place during operation of the apparatus. In some embodiments, there are three pressure loaded gas springs. In other embodiments, there are four or five pressure loaded gas springs. The pressure loaded gas springs 410A may contain a pressure of up to 1000 psi, 2000 psi, or 3000 psi. The force provided by the gas springs may range from 50 N up to 1000 N. Gas springs provide a constant force which is important to a smooth and controlled pull of the handle 310 during operation. The gas springs 410 may be composed of stainless steel or carbon steel. The gas springs 410, in some embodiments, contain nitrogen. Nitrogen provides a neutral charge which is important to avoid explosions. Nitrogen gas springs are also cheaper due to the large abundance of nitrogen in the atmosphere.

FIG. 12 depicts a preferable routing of the cable 330 through the base plate 200. The cable 330 routes through the pulley 240 and into the base plate 210, wherein the cable 330 is redirected into a circular channel 230 by a vertical bearing bar 250. The cable 330 may suitably be wound in between the two flywheels 260 and constrained by the spring assembly 400. In some embodiments (not shown here), the cable 330 may be comprised of two separate lines, in which one is fastened to the other by means of a hook. The cable 330 is configured to withstand high forces exerted upon the cable during use. In some embodiments, a winch is employed to pull in or let out cable during operation of the apparatus. In some embodiments, the cable 330 is fastened to the flywheels 260 by M6 screws. In other embodiments, the cable 330 is fastened to the flywheel 260 by bolts, nuts, or pins. The cable 330 possesses a length long enough to perform shoulder height exercises. In some embodiments, this length is 10 feet to 13 feet. In other embodiments, the cable is up to 30 feet.

In FIG. 12, the positioning of the pulley 240 may be adjusted around the apparatus 100. The pulley 240 may be attached to a pulley plate 290 that slides within a pulley slot 270 within the apparatus 100. The positioning of the pulley plate 290 changes the pulling direction of the pulley and allows for different exercises. The pull pin 280 engages and locks into a pin hole (not shown) to lock the pulley plate 290 in a certain position. A user may pull the pull pin 280 which disengages the pulley plate 290 and allows the user to slide the pulley plate 290 along the pulley slot 270. In one configuration, the pulleys 240 may be oriented on a parallel axis relative to one another. In another configuration, each pulley 240 may be oriented at a 45° angle relative to the central plane of the apparatus 100.

In FIG. 12, the apparatus may feature a handle slot 150 to lift and carry the apparatus 100. In other embodiments, the apparatus may feature carrying straps to carry the apparatus on a user's back or in a user's hands.

In some embodiments, the apparatus may include accessories to provide additional functionality. Accessories may include additional weights to prevent movement of the apparatus during use. Other accessories include attachable carrying straps or different handles for particular exercises. In certain embodiments, the apparatus may be fixed to a wall through the use of a bolt and pinhole mechanism. The apparatus may also be mounted to a wall through the use of a bracket attachment or other means. Mounting the apparatus to the wall may provide for different exercises such as punching or boxing exercises.

In one embodiment, the disclosed exercise equipment comprises: a base; a pair of handle assemblies, each handle assembly comprising a handle and a loop; a cable wrapped circularly between two flywheels within the base, wherein the cable exits out of the base through a pulley and attaches to each handle assembly; wherein said flywheels are operatively engaged to a spring mechanism that stores a load generated by a compression force; said load configured to counteract the force generated by pulling of the handle assembly; and wherein said load is controllably adjusted by spring loaded locks.

The features will be understood with reference to the drawings. While various embodiments of the method and apparatus have been described above, it should be understood that they have been presented by way of example only, and not of limitation. Likewise, the various diagrams might depict an example of an architectural or other configuration for the disclosed method and apparatus, which is done to aid in understanding the features and functionality that might be included in the method and apparatus. The disclosed method and apparatus is not restricted to the illustrated example architectures or configurations, but the desired features might be implemented using a variety of alternative architectures and configurations. Indeed, it will be apparent to one of skill in the art how alternative functional, logical or physical partitioning and configurations might be implemented to implement the desired features of the disclosed method and apparatus. Also, a multitude of different constituent module names other than those depicted herein might be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the method and apparatus is described above in terms of various exemplary embodiments and implementations, it should be understood that the various features, aspects and functionality described in one or more of the individual embodiments are not limited in their applicability to the particular embodiment with which they are described, but instead might be applied, alone or in various combinations, to one or more of the other embodiments of the disclosed method and apparatus, whether or not such embodiments are described and whether or not such features are presented as being a part of a described embodiment. Thus the breadth and scope of the claimed invention should not be limited by any of the above-described embodiments.

Additionally, the various embodiments set forth herein are described in terms of exemplary illustrations. As will become apparent to one of ordinary skill in the art after reading this document, the illustrated embodiments and their various alternatives might be implemented without confinement to the illustrated examples. For example, block diagrams and their accompanying description should not be construed as mandating a particular architecture or configuration.

Claims submitted herewith are incorporated by reference into the specification as if fully set forth herein.

We claim:

1. A portable exercise apparatus comprising:

a portable base assembly that features an octagonal base plate that defines a bottom of the portable base assembly, and an octagonal platform that defines a top of the portable base assembly, wherein the octagonal platform is positioned above the octagonal base to form eight sides of the portable base assembly, and wherein each one of said eight sides is symmetrically opposed to another one of said eight sides;

a first spring assembly that is installed inside the portable base assembly and positioned on a top side of the octagonal base plate;

a first flywheel that is rotatably installed inside the portable base assembly and positioned above the first spring assembly, wherein the first spring assembly is affixed to the first flywheel so that the first spring assembly compresses when the first flywheel is rotated in a first direction;

a second flywheel that is rotatably installed inside of the portable base assembly and positioned above the first flywheel;

a second spring assembly that is installed inside of the portable base assembly and positioned above said second flywheel and that is assembled so that the second spring assembly operates in a reverse direction relative to the first spring assembly, wherein the second spring assembly is affixed to the second flywheel so that the second spring assembly compresses when the second flywheel is rotated in a second direction;

a first portion of cable that routes through the first flywheel;

a second portion of cable that routes through the second flywheel;

a first pulley and a second pulley, wherein the first pulley is positionable on at least a first two of said sides and wherein said second pulley is positionable on at least a second two of said sides so that the first two of said sides are symmetrically opposed to the second two of said sides;

wherein the first portion of cable is provided through said first pulley as said first portion of cable extends from the portable base assembly;

wherein the second portion of cable is provided through said second pulley as said second portion of cable extends from the portable base assembly;

a first handle assembly and a second handle assembly, wherein the first handle assembly is positioned at a distal end of the first portion of cable outside of the portable base assembly and wherein the second handle assembly is positioned at a distal end of the second portion of cable outside of the portable base assembly;

said first handle assembly mechanically coupled to the first portion of cable, the first flywheel, and the first spring assembly so that a first tensile load established by a user over the first portion of cable via the first handle assembly causes the causes the first portion of cable to extend from the portable base assembly, the first flywheel to rotate in the first direction, and the first spring assembly to compress;

said second handle assembly mechanically coupled to the second portion of cable, the second flywheel, and the second spring assembly so that a second tensile load established by the user over the second portion of cable via the second handle assembly causes the causes the second portion of cable to extend from the portable base assembly, the second flywheel to rotate in the second direction, and the second spring assembly to compress;

wherein the user may operate the portable exercise apparatus from a proximate distance.

2. The portable exercise apparatus of claim 1, wherein the first spring assembly contains gas springs.

3. The portable exercise apparatus of claim 1, further comprising the portable base assembly in an upright position where one of said eight sides interfaces with a floor so that the user may sit on one of said eight sides that is symmetrically opposed to said side interfacing with the floor while applying the said first or second tensile load.

4. The portable exercise apparatus of claim 3, wherein the portable base assembly is composed of an aluminum frame.

5. The portable exercise apparatus of claim 3, wherein the portable base assembly is composed of a plastic frame.

6. The apparatus of claim 1, wherein the compression of the first spring assembly is adjustable relative to the established first tensile load by the user.

7. A method of exercise comprising:

lifting a portable exercise apparatus, said portable exercise apparatus comprising:

a portable base assembly that features an octagonal base plate that defines a bottom of the portable base assembly, and an octagonal platform that defines a top of the portable base assembly, wherein the octagonal platform is positioned above the octagonal base to form eight sides of the portable base assembly, and wherein each one of said eight sides is symmetrically opposed to another one of said eight sides;

a first spring assembly that is installed inside the portable base assembly and positioned on a top side of the octagonal base plate;

a first flywheel that is rotatably installed inside the portable base assembly and positioned above the first spring assembly, wherein the first spring assembly is affixed to the first flywheel so that the first spring assembly compresses when the first flywheel is rotated in a first direction;

a second flywheel that is rotatably installed inside of the portable base assembly and positioned above the first flywheel;

a second spring assembly that is installed inside of the portable base assembly and positioned above said second flywheel and that is assembled so that the second spring assembly operates in a reverse direction relative to the first spring assembly, wherein the second spring assembly is affixed to the second flywheel so that the second spring assembly compresses when the second flywheel is rotated in a second direction;

a first portion of cable that routes through the first flywheel;

a second portion of cable that routes through the second flywheel;

a first pulley and a second pulley, wherein the first pulley is positionable on at least a first two of said sides and wherein said second pulley is positionable on at least a second two of said sides so that the first two of said sides are symmetrically opposed to the second two of said sides;

wherein the first portion of cable is provided through said first pulley as said first portion of cable extends from the portable base assembly;

wherein the second portion of cable is provided through said second pulley as said second portion of cable extends from the portable base assembly;

a first handle assembly and a second handle assembly, wherein the first handle assembly is positioned at a distal end of the first portion of cable outside of the portable base assembly and wherein the second handle assembly is positioned at a distal end of the second portion of cable outside of the portable base assembly;

said first handle assembly mechanically coupled to the first portion of cable, the first flywheel, and the first spring assembly so that a first tensile load established by a user over the first portion of cable via the first handle assembly causes the causes the first portion of cable to extend from the portable base assembly, the first flywheel to rotate in the first direction, and the first spring assembly to compress;

said second handle assembly mechanically coupled to the second portion of cable, the second flywheel, and the second spring assembly so that a second tensile load established by the user over the second portion of cable via the second handle assembly causes the causes the second portion of cable to extend from the portable base assembly, the second flywheel to rotate in the second direction, and the second spring assembly to compress;

wherein the user may operate the portable exercise apparatus from a proximate distance;

setting the portable exercise apparatus on a surface so that the octagonal base plate interfaces with the surface;

coupling the first handle assembly to a body part of a user and establishing the first tensile force over the first portion of cable via movement of the body part.

8. The method of exercise of claim 7, further comprising the step of coupling the second handle assembly to another body part of the user and establishing the second tensile force over the second portion of cable via movement of said another body part.

9. The method of exercise of claim 7, wherein the second spring assembly contains gas springs.

10. The exercise apparatus of claim 6, wherein said second spring assembly contains springs.

11. The exercise apparatus of claim 6, wherein said compression of the first spring assembly is controllably adjusted by spring loaded locks.

12. The method of claim 7, further comprising the step of positioning the portable base assembly so that one of said eight sides interfaces with the surface.

13. The method of claim 12, further comprising the step of sitting on one of the sides of the portable base assembly, wherein said one of the sides of the portable base assembly that is sat upon is symmetrically opposed to the one of the eight sides that is interfaced with the surface.

14. The method of claim 7, further comprising the step of moving the first pulley from one said sides of the portable base assembly to another of said sides of the portable base assembly.

* * * * *